US010392884B2

(12) United States Patent
Adam et al.

(10) Patent No.: US 10,392,884 B2
(45) Date of Patent: Aug. 27, 2019

(54) PRESSURE SET LINER HANGER/PACKER WITHOUT TUBING WALL PORT

(71) Applicant: BAKER HUGHES, A GE COMPANY, LLC, Houston, TX (US)

(72) Inventors: Mark K. Adam, Houston, TX (US); Keven O'Connor, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 325 days.

(21) Appl. No.: 15/374,144

(22) Filed: Dec. 9, 2016

(65) Prior Publication Data

US 2017/0292339 A1 Oct. 12, 2017

Related U.S. Application Data

(60) Provisional application No. 62/321,520, filed on Apr. 12, 2016.

(51) Int. Cl.

| | |
|---|---|
| ***E21B 23/01*** | (2006.01) |
| ***E21B 23/06*** | (2006.01) |
| ***E21B 33/129*** | (2006.01) |
| ***E21B 43/10*** | (2006.01) |

(52) U.S. Cl.

CPC ..... *E21B 23/01* (2013.01); *E21B 23/06* (2013.01); *E21B 33/1293* (2013.01); *E21B 43/10* (2013.01)

(58) Field of Classification Search

CPC ..... E21B 23/01; E21B 23/06; E21B 23/04; E21B 43/10; E21B 33/1293; E21B 33/129

See application file for complete search history.

(56) References Cited

U.S. PATENT DOCUMENTS 3,033,290 A * 5/1962 Brown ..... E21B 23/06 166/124

5,377,749 A * 1/1995 Barbee ..... E21B 23/06 166/120

* cited by examiner

*Primary Examiner* — George S Gray

(74) *Attorney, Agent, or Firm* — Shawn Hunter

(57) ABSTRACT

Wall openings in a mandrel of a liner hanger/packer are eliminated and setting is accomplished with pressure against a landed object in a running tool. The wall of the running tool leads to a sealed annular space with a movable seal attached to a setting sleeve and the other end is a packer cup supported by the running tool. The setting sleeve sequentially sets the slips and releases the running tool followed by setting the packer seal. Optionally a dog sub can be used to set with set down weight on the setting sleeve. The set positions are locked in. The slips can be alternatively set with release of a contained spring force. The setting sleeve seal can be sheared out to allow removal of the running tool.

22 Claims, 3 Drawing Sheets

PRESSURE SET LINER HANGER/PACKER WITHOUT TUBING WALL PORT

CROSS REFERENCE TO RELATED APPLICATION

This application is claims priority from U.S. Provisional Patent Application Ser. No. 62/321,520, filed on Apr. 12, 2016, the disclosure of which is incorporated herein by reference in its entirety.

FIELD OF THE INVENTION

The field of the invention is pressure settable liner hanger/packers and more particularly where there is no liner wall port for pressure setting while still leaving an option for a backup setting with setting down weight.

BACKGROUND OF THE INVENTION

Current hydraulic set liner hangers have a tubing wall port that leads into a hydraulic cylinder mounted on the outside of the mandrel of the liner hanger. The hydraulic cylinder can then be pressured up to generate the force required to set the liner hanger. The limitation of this design is that the hydraulic cylinders are permanently exposed to internal liner pressure and must be able to withstand the full pressure rating of the liner. In some cases the liner pressure rating is limited by the hydraulic cylinder. Also the hydraulic cylinder seals must be qualified per industry specification and the seals themselves can be undesirable as they rely on elastomers for sealing versus the threaded connections of the liner that are metal to metal seals. The present invention does away with hydraulic cylinder concerns as it places the hydraulic cylinder on the running tools which are retrieved following the job.

The present invention incorporates a setting sleeve movably mounted with respect to a mandrel of the hanger/packer. The sleeve can be forced uphole with pressure in a running tool that is directed to a sealed volume between a packer cup on a running tool and an external seal on the setting sleeve that contacts the running tool. Tubing pressure pushes the setting sleeve up to set the slips with a lost motion feature that is controlled with shear devices to allow a further pressurization to a higher pressure to then set and lock the packer. Alternatively, the running tool can be released before anything is set so that dogs can extend for setting down weight on the setting sleeve to then set the slips and then the packer after a cement job is concluded. The cone that sets the packer seal is pulled in tension under the sealing element. The upper seal on the setting sleeve allows running tool pressure to push the setting sleeve uphole for the normal operation of the tool. The upper seal can be sheared out with pressure to let the dog sub extend above the setting sleeve for setting liner hanger/packer with set down weight. The running tool releases from the liner hanger/packer after additional pressure is applied against an object on a seat in the running tool with the hanger slips already set. Seal assembly and slip location placement can be reversed so that the slips are above the packer seal. Pressure through the running tool can directly or indirectly with a hydraulic tool be used to move the setting sleeve. One of the slip seats can be an integral part of the mandrel of the liner hanger/packer or a separate part connected to it such as with threads. These and other aspects of the present invention will be more readily appreciated by a review of the detailed description of the preferred embodiment and the associated drawings while recognizing that the full scope of the invention is to be determined by the appended claims.

SUMMARY OF THE INVENTION

Wall openings in a mandrel of a liner hanger/packer are eliminated and setting is accomplished with pressure against a landed object in a running tool. The wall of the running tool leads to a sealed annular space with a movable seal attached to a setting sleeve and the other end is a packer cup supported by the running tool. The setting sleeve sequentially sets the slips and releases the running tool followed by setting the packer seal. Optionally a dog sub can be used to set with set down weight on the setting sleeve. The set positions are locked in. The slips can be alternatively set with release of a contained spring force. The setting sleeve seal can be sheared out to allow removal of the running tool.

DETAILED DESCRIPTION OF THE PREFERRED EMBODIMENT

Figure 1:
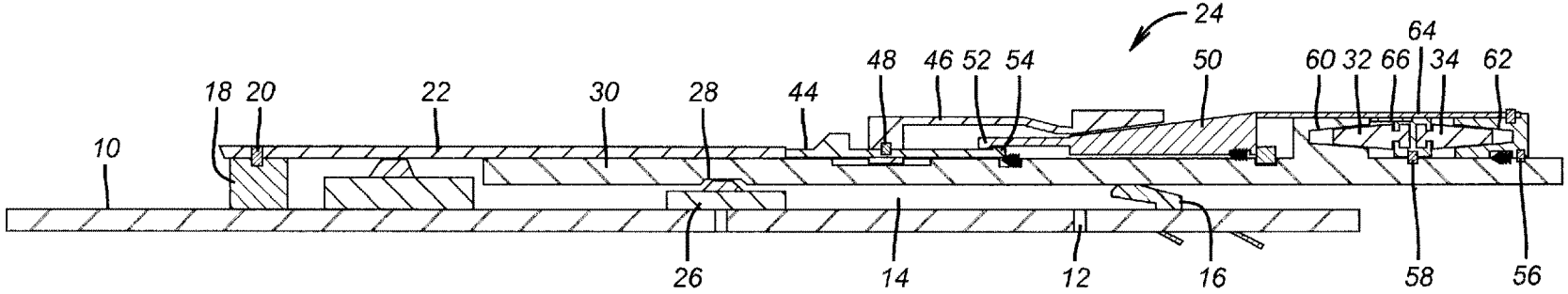
FIG. 1 is a schematic representation of the liner hanger/packer in the run in position.
Figure 3:
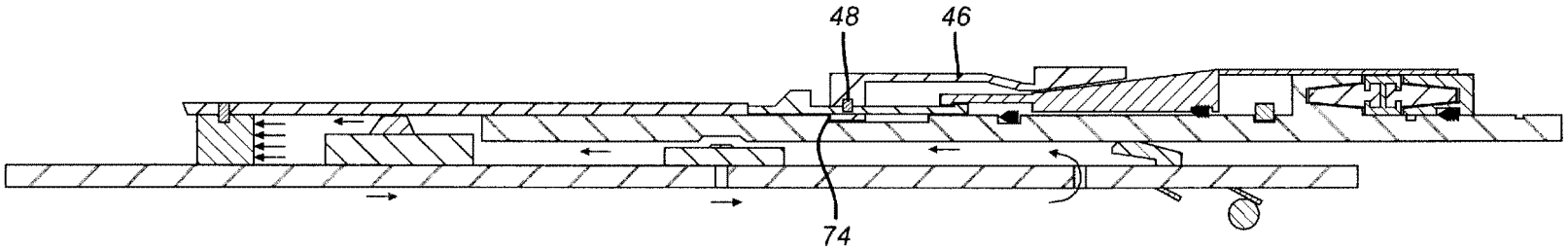
FIG. 3 is the view of FIG. 2 showing the running tool released.

Referring to FIG. 1 the running tool 10 has a port 12 that leads into an annular space 14 between a packer cup 16 and a packoff 18 held with a shear screw 20 to the setting sleeve 22 of the liner hanger/packer 24. A releasable retainer 26 such as an array of collets is engaged to groove 28 on mandrel 30 of the liner hanger/packer 24. The retainer 26 is releasable with an applied pressure in the running tool 10 as shown in FIG. 3. Typically the pressure creates a force to break a shear member to permit the relative movement that allows the running tool 10 to release from mandrel 30 after the slips 32 and 34 are set. The slips 32 and 34 have wickers with opposed orientations to resist differential pressure in opposed directions.

Figure 2:
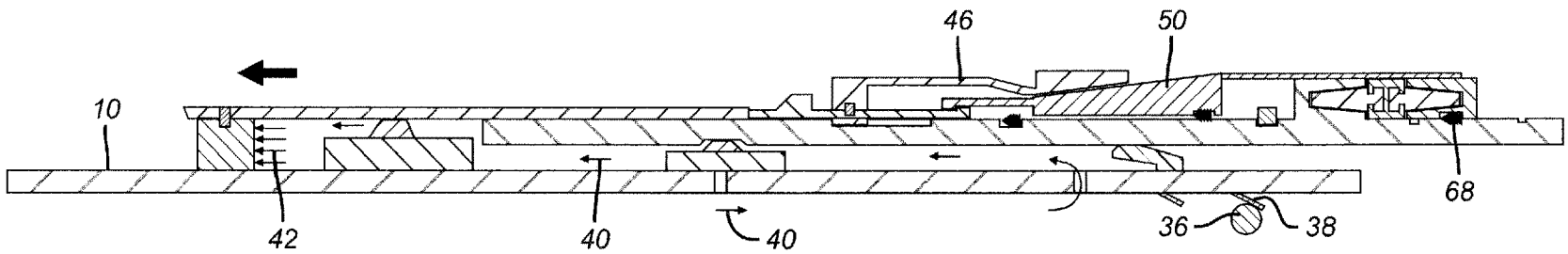
FIG. 2 is the view of FIG. 1 in the liner hanger set position.

The slips are set normally by pressure applied in the running tool 10 that communicates with annular space 14 through port 12. The pressurizing is made possible with the landing of an object 36 on seat 38 in a passage of the running tool 10. Arrows 40 and 42 show that pressure in annular space 14 results in pressure on the packoff 18 which moves the setting sleeve 22 in an uphole direction. Setting sleeve 22 is connected to extension sleeve 44 with the packer seal 46 shear pinned to extension sleeve 44 at shear pin 48. Cone 50 extends under seal 46 and has a shoulder 52 grabbed by shoulder 54 on extension sleeve 44. Initially, when setting slips 32 and 34, the cone 50 moves in tandem with the seal 46 as shear pin 48 does not break. Instead shear pins 56 and 58 break sequentially as slips 32 and 34 ride up their respective inclined ramps 60 and 62 when pulled up with actuator 64 held on by shear pin 66. A lock ring 68 holds the FIG. 2 set position of the slips 32 and 34 after the shear pin 66 shears out. Cone 50 and packer seal 46 have moved in tandem so that there is no radial extension of seal 46 on ramp 50 in the FIG. 2 position.

Figure 4:
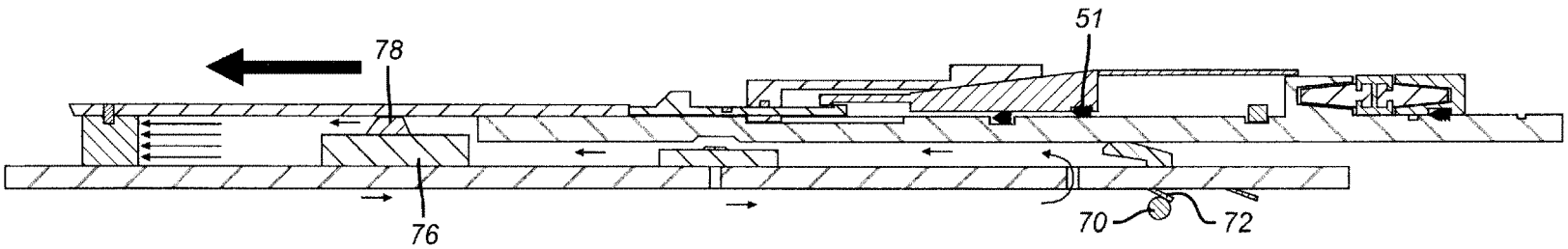
FIG. 4 is the view of FIG. 3 showing the packer set with pressure.

Typically, after the slips 32 and 34 are set an additional force using pressure against object 36 allows the retainer 26 to release the running tool 10 followed by blowing the object 36 through the seat 38. At this point a cementing job takes place and fluid displaced by the cement can go up between the spaces between the set slips 32 and 34. FIG. 3 shows schematically the retainer 26 released while the running tool 10 is still inside the mandrel 30. At this time another object 70 is dropped on seat 72 to once again allow pressuring up on annular space 14. Seal 46 already at travel stop 74 on mandrel 30 from the setting of the slips 32 and 34 cannot move so that movement of the setting sleeve 22 results in breaking the shear pin 48 and axial movement of cone 50 under seal 46 under a tensile force. The seal 46 moves out radially by the fact that cone 50 is pulled from above seal 46 and under seal 46 until the surrounding tubular that is not shown is engaged for the conclusion of the setting of seal 46. Lock ring 51 prevents cone 50 from reversing direction. This is the FIG. 4 position and the running tool 10 can now be pulled out as the shear pin 20 is sheared so that the packoff 18 comes out with the running tool 10 as does the packer cup 16. Object 70 can be blown or passed through the seal 72 to prevent pulling a wet string when removing the running tool 10.

Figure 5:
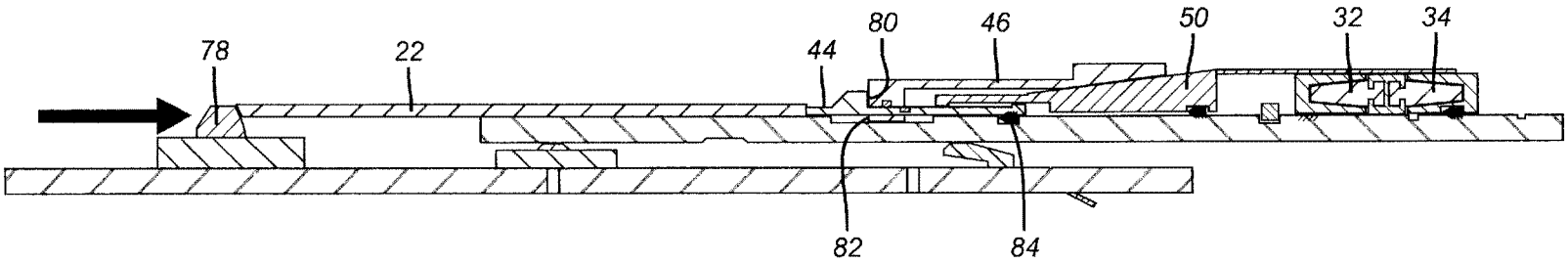
FIG. 5 shows an alternative setting of the liner hanger/packer with set down weight using a dog sub on the running tool.

A dog sub 76 of a type known in the art is mounted to the running tool 10. Once the dog sub 76 comes out of the setting sleeve 22 the dogs 78 extend out radially to provide a backup way to set the seal 46 with set down weight of the dogs 78 on setting sleeve 22 with slips 34 resisting the set down weight. This is shown in FIG. 5. The shoulder 80 of the extension sleeve 44 lands on shoulder 82 of seal 46 and the setting movement is trapped as body lock ring 84 prevents reverse movement of extension sleeve 44.

Figure 6:
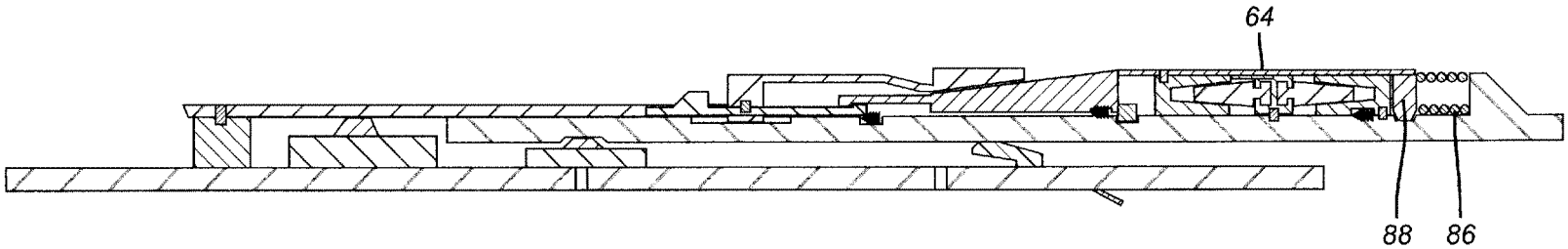
FIG. 6 is the view of FIG. 1 with the liner hanger set with stored potential energy released from a spring.

FIG. 6 is the same as FIG. 1 with the difference being that pulling on actuator 64 releases dog 88 to allow the force built up in compressed spring 86 to be delivered to extend slips 32 and 34 in the manner described above.

Those skilled in the art will appreciate that the above described designs remove limitations imposed by the pressure rating of a hydraulic actuator that would otherwise be used to set the slips and seal. The actuation system described does not need to be qualified to API standards as it is not an adjunct to the mandrel of the liner hanger/packer. Various seals that would otherwise be used and present a potential for leakage would also be eliminated.

The setting sleeve 22 can be shear pinned for running in to the packer mandrel 30 and its motion relative to the mandrel 30 can be locked with a body lock ring 84. The cone 50 can be pulled up in tandem with the seal 46 as the slips 32 and 34 are set. Ultimately the seal 46 shoulders out at 74 to break pin 48 to allow the cone 50 to move under the seal 46. Seal 46 can be set with an uphole force that is pressure created or with set down weight. The cone 50 is under tensile stress when setting slips 32 and 34. Packoff 18 acts as a piston to move the setting sleeve 22. The slips 32 and 34 can be bidirectional when both are used or unidirectional and either can be used alone or as an opposed pair. The seal 46 can be above or below the slips 32 and 34. As an option instead of the packoff 18 the pressure can be directed to a hydraulic tool that pulls up the setting sleeve 22. Slip ramp 60 that is shown integral to mandrel 30 can be a separate structure threaded to it.

The above description is illustrative of the preferred embodiment and many modifications may be made by those skilled in the art without departing from the invention whose scope is to be determined from the literal and equivalent scope of the claims below:

We claim:

1. An actuation assembly for a first and second tool mounted externally to a tubular mandrel having an open uphole end and no wall ports, comprising:

the first and second tool mounted to the tubular mandrel;

a running tool mandrel selectively connected to an inner surface of said tubular mandrel through said uphole end and operably connected to a setting sleeve assembly disposed outside of said tubular mandrel, said setting sleeve assembly operably connected to said first and second tools and movable axially relative to said first and second tools for actuation thereof; and an annular seal spanning an annular gap between said setting sleeve assembly and said running tool mandrel, said annular seal selectively connected to said setting sleeve assembly for movement of said setting sleeve assembly with pressure in a direction away from said first and second tools for actuation thereof.

2. The assembly of claim 1, wherein:

said running tool mandrel is sealingly connected to said tubular mandrel inner surface.

3. The assembly of claim 1, wherein:

said setting sleeve assembly is moved with pressure applied through said running tool mandrel.

4. The assembly of claim 1, wherein:

a dog sub mounted to said mandrel comprising at least one dog in contact with said setting sleeve assembly with the dog in a retracted position, said at least one dog extending beyond said setting sleeve assembly when removed therefrom to allow said at least one dog to transfer force from said running tool mandrel to said setting sleeve assembly in a direction toward said first and second tool for setting at least one of said tools.

5. The assembly of claim 1, wherein:

said first and second tool are actuated at different times with movement of said setting sleeve assembly in a single direction.

6. The assembly of claim 1, wherein:

said running tool mandrel releases from said tubular mandrel after first said first tool is actuated.

7. The assembly of claim 1, wherein:

said setting sleeve assembly actuates the first tool while the setting sleeve assembly is moving in tandem with said second tool for a predetermined distance before the second tool is set with relative movement of said setting sleeve assembly to the second tool.

8. The assembly of claim 1, wherein:

said first and second tools are locked after being set by said setting sleeve assembly.

9. The assembly of claim 1, wherein:

at least one of said tools is alternatively set by said setting sleeve assembly with discrete movements of said setting sleeve assembly in opposed uphole or downhole directions.

10. The assembly of claim 9, wherein:

said first tool is set with uphole movement of said setting sleeve assembly and said second tool is set with further uphole movement of said setting sleeve assembly or downhole movement of said setting sleeve assembly pushing against said set first tool.

11. The assembly of claim 1, wherein:

said running tool mandrel comprises a passage surrounded by at least one seat and a well opening located uphole of a flexible seal spanning a lower end of an annular gap between said tubular mandrel and said running tool mandrel, said annular gap closed by an upper seal selectively connected to said setting sleeve assembly, whereupon landing an object on said at least one seat and applying pressure moves said setting sleeve assembly uphole to set said first and second tools.

12. The assembly of claim 1, wherein:

said first tool comprises slips on a liner hanger and said second tool comprises a seal on said liner hanger.

13. The assembly of claim 12, wherein:

said running tool mandrel is sealingly connected to said tubular mandrel inner surface.

14. The assembly of claim 13, wherein:

said setting sleeve assembly is moved with pressure applied through said running tool mandrel.

15. The assembly of claim 14, further comprising:

an annular seal spanning an annular gap between said setting sleeve assembly and said running tool mandrel, said annular seal selectively connected to said setting sleeve assembly for movement of said setting sleeve assembly with pressure in a direction away from said slip and said seal on said liner hanger to a set position.

16. The assembly of claim 15, wherein:

a dog sub is mounted to said mandrel comprising at least one dog in contact with said setting sleeve assembly with the dog in a retracted position, said at least one dog extending beyond said setting sleeve assembly when removed therefrom to allow said at least one dog to transfer force from said running tool mandrel to said setting sleeve assembly in a direction toward said slips and seal on said liner hanger for setting said liner hanger seal by bracing against said set liner hanger slips.

17. The assembly of claim 12, wherein:

said slips and said liner hanger seal are actuated at different times with movement of said setting sleeve assembly in a single direction.

18. The assembly of claim 12, wherein:

said running tool mandrel releases from said tubular mandrel after said slips are set.

19. The assembly of claim 12, wherein:

said setting sleeve assembly actuates said slips while moving in tandem with said liner hanger seal for a predetermined distance before said liner hanger seal is set with relative movement of said setting sleeve assembly to said liner hanger seal.

20. The assembly of claim 12, wherein:

said liner hanger slips and seal are locked after being set by said setting sleeve assembly.

21. The assembly of claim 12, wherein:

said liner hanger seal is alternatively set by said setting sleeve assembly with discrete movements of said setting sleeve assembly in opposed uphole or downhole directions.

22. The assembly of claim 21, wherein:

said liner hanger slips are set with uphole movement of said setting sleeve assembly and said liner hanger seal is set with further uphole movement of said setting sleeve assembly or downhole movement of said setting sleeve assembly pushing against said set liner hanger slips.

* * * * *